US009746010B2

(12) United States Patent
Roy et al.

(10) Patent No.: US 9,746,010 B2
(45) Date of Patent: Aug. 29, 2017

(54) NOISE CONTROL OF CAVITY FLOWS USING ACTIVE AND/OR PASSIVE RECEPTIVE CHANNELS

(71) Applicant: University of Florida Research Foundation, Gainesville, FL (US)

(72) Inventors: Subrata Roy, Gainesville, FL (US); Arnob Das Gupta, Gainesville, FL (US)

(73) Assignee: UNIVERSITY OF FLORIDA RESEARCH FOUNDATION, INCORPORATED, Gainesville, FL (US)

( * ) Notice: Subject to any disclaimer, the term of this patent is extended or adjusted under 35 U.S.C. 154(b) by 233 days.

(21) Appl. No.: 14/680,887

(22) Filed: Apr. 7, 2015

(65) Prior Publication Data

US 2015/0292533 A1 Oct. 15, 2015

Related U.S. Application Data

(60) Provisional application No. 61/977,288, filed on Apr. 9, 2014.

(51) Int. Cl.
*F15C 1/04* (2006.01)
*F15D 1/12* (2006.01)
*F15D 1/00* (2006.01)

(52) U.S. Cl.
CPC ..... *F15D 1/12* (2013.01); *F15D 1/0025* (2013.01); *F15D 1/0075* (2013.01)

(58) Field of Classification Search
CPC ..... F15D 1/12; F15D 1/0025; F15D 1/0075; Y10T 137/218; Y10T 137/2191
USPC ..... 137/825, 827; 315/111.21, 111.41, 315/111.61; 313/231.31
See application file for complete search history.

(56) References Cited

U.S. PATENT DOCUMENTS 3,371,491 A * 3/1968 Pinter ..... F02K 9/82 239/265.19
3,521,837 A * 7/1970 Papst ..... B64C 21/06 244/130
4,664,345 A * 5/1987 Lurz ..... B64C 21/025 244/130
6,615,857 B1 * 9/2003 Sinha ..... G05D 7/0629 137/14
6,752,358 B1 * 6/2004 Williams ..... B64C 1/12 244/208
7,183,515 B2 * 2/2007 Miller ..... B64C 23/005 219/121.5
7,334,394 B2 * 2/2008 Samimy ..... F01D 25/30 239/265.19
7,686,256 B2 * 3/2010 Miller ..... B64C 21/04 244/198

(Continued)

FOREIGN PATENT DOCUMENTS

WO 2011/156408 12/2011

*Primary Examiner* — Jessica Cahill
*Assistant Examiner* — Minh Le
(74) *Attorney, Agent, or Firm* — Thomas | Horstemeyer, LLP

(57) ABSTRACT

An apparatus comprises a surface that is configured to be exposed to a fluid stream and a cavity wall that forms at least a portion of a cavity. A first channel opening is formed in the surface, and a second channel opening is formed in the cavity wall. A channel extends from the first channel opening in the cavity wall to the second channel opening in the surface.

19 Claims, 7 Drawing Sheets

(56) References Cited

U.S. PATENT DOCUMENTS 7,748,664 B2 * 7/2010 Boespflug ..... B64C 23/005 239/265.19
7,802,760 B2 * 9/2010 Webster ..... F01D 5/145 244/207
7,967,258 B2 * 6/2011 Smith ..... B64C 21/08 239/102.2
7,984,614 B2 * 7/2011 Nolcheff ..... F23C 99/001 60/726
8,016,247 B2 * 9/2011 Schwimley ..... B64C 23/005 244/200
8,091,837 B2 * 1/2012 Frankenberger ..... B64C 21/06 244/209
8,235,072 B2 8/2012 Roy
8,235,309 B2 * 8/2012 Xu ..... B64C 21/04 239/102.1
8,490,926 B2 * 7/2013 Clingman ..... B64C 21/04 244/207
9,003,990 B2 * 4/2015 Jones ..... B63B 1/38 114/67 A
9,067,674 B2 * 6/2015 Nordin ..... B64C 23/005
9,074,613 B2 * 7/2015 Bonnet ..... B64C 23/005
2002/0134891 A1 * 9/2002 Guillot ..... B64C 3/00 244/204.1
2004/0118973 A1 * 6/2004 Malmuth ..... B64C 5/12 244/75.1
2006/0273197 A1 * 12/2006 Saddoughi ..... B05B 1/08 239/265.17
2007/0089795 A1 * 4/2007 Jacob ..... B64C 23/005 137/827
2010/0258046 A1 * 10/2010 Berger ..... B63B 1/38 114/274
2011/0253842 A1 * 10/2011 Silkey ..... B64C 23/005 244/205
2012/0291874 A1 * 11/2012 Tanaka ..... F01D 5/145 137/13
2013/0038199 A1 * 2/2013 Roy ..... H05H 1/24 313/231.31
2013/0277502 A1 * 10/2013 Bauer ..... B64C 21/08 244/208

* cited by examiner

NOISE CONTROL OF CAVITY FLOWS USING ACTIVE AND/OR PASSIVE RECEPTIVE CHANNELS

CROSS-REFERENCE TO RELATED APPLICATIONS

The present application is a non-provisional application of, and claims priority to, U.S. Provisional Application No. 61/977,288, filed on Apr. 9, 2014 and titled "NOISE CONTROL OF CAVITY FLOWS USING ACTIVE AND/OR PASSIVE RECEPTIVE CHANNELS," which is incorporated by reference herein in its entirety.

BACKGROUND

Fluidic flow over an open cavity may generate impinging shear layers in the fluid. These impinging shear layers may result in pressure oscillations. Free shear layers in an open cavity become unstable and create relatively large vortical structures which may impinge on the trailing edge of the cavity and produce periodic acoustic waves. These waves may propagate upstream in the fluid and impact the shear layer at the layer separation point, thereby causing instability in the fluid.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

The present disclosure relates to implementing noise control of cavity flows using active and/or passive receptive channels. In some embodiments, a channel is formed between a cavity wall and an exterior surface of a body. When a fluid stream flows across the opening of the cavity, the channel facilitates the pressure differential across points near the openings of the channel being lower than would otherwise exist if the channel was not present. In particular, fluid flows through the channel so that the pressure differential is reduced. As a result, the amplitude of pressure oscillations that may be generated from the fluid stream flowing over the cavity is less than what would otherwise be generated if the channel were not present.

Figure 1A:
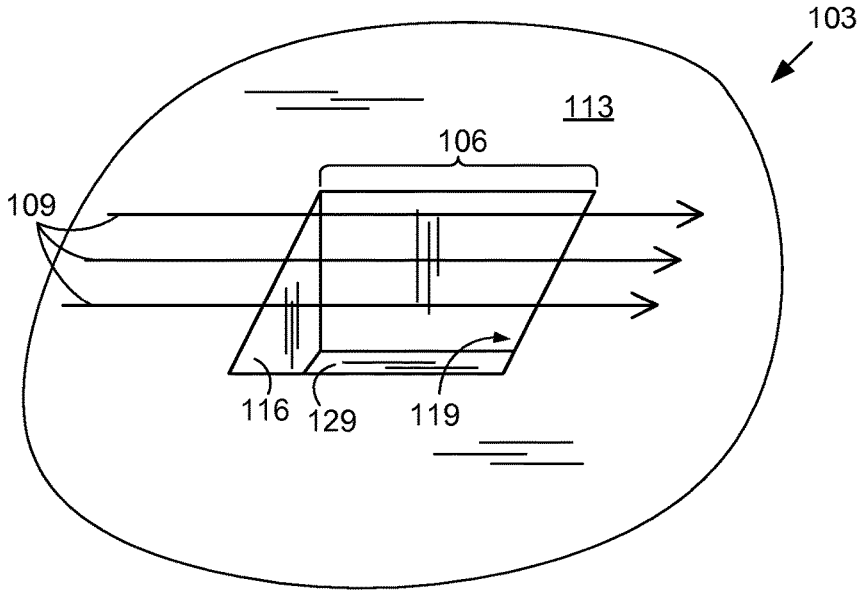
FIG. 1A is a drawing of a first example of a body with a cavity being exposed to a fluid stream according to various embodiments of the present disclosure.
Figure 1B:
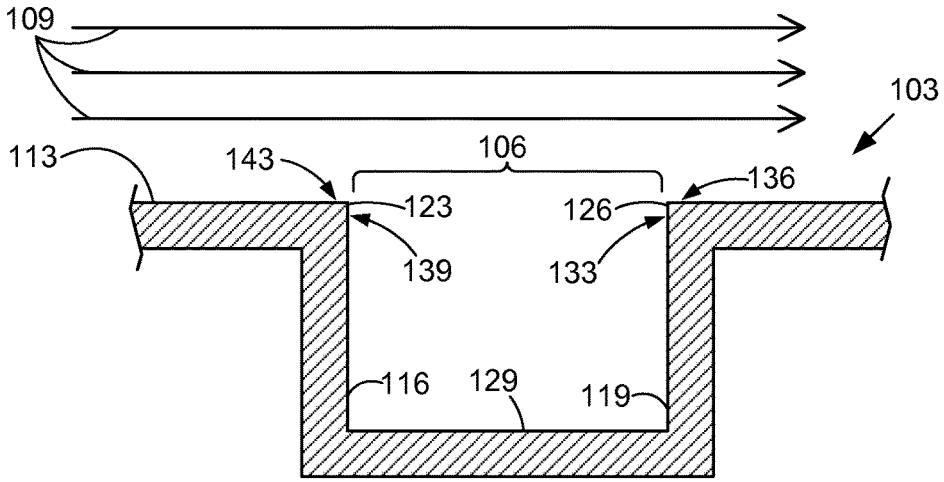
FIG. 1B is a cross-sectional view of the body of FIG. 1A with the cavity being exposed to a fluid stream according to various embodiments of the present disclosure.

With reference to FIGS. 1A-1B, shown is an example of a portion of a body 103 according to various embodiments of the present disclosure. In particular, FIG. 1A shows a perspective view of a portion of the body 103, and FIG. 1B shows a cross-section of a portion of the body 103.

FIGS. 1A-1B show the body 103 with a cavity 106 being exposed to a fluid stream 109. The body 103 may represent various types of objects. For example, the body 103 may represent an aircraft, a pipe, or any other type of object that may be exposed to a fluid stream 109. The fluid stream 109 may be, for example, air through which the body 103 is traveling, a liquid flowing across the body 103, or any other type of fluid that is moving with respect to the body 103. Thus, a as a non-limiting example, FIGS. 1A-1B may represent a portion of an aircraft traveling through an air mass. Alternatively, FIGS. 1A-1B may represent an interior portion of a pipe with a liquid flowing therein. The fluid stream 109 is represented with arrows in FIGS. 1A-1B, and the direction of flow of the fluid stream 109 with respect to the body 103 is indicated by the direction of the arrows.

The body 103 includes a surface 113 that is exposed to the fluid stream 109. Such a surface 113 may be, for example, the exterior skin of an aircraft, the interior wall of a pipe, or any other portion of the body 103 that is exposed to the fluid stream 109. As shown, an opening is formed in the surface 113, which defines a cavity 106 in the body 103. Although the cavity 106 is shown as having a cubical shape, alternative embodiments may comprise cylindrical shapes or any other types of shapes. As non-limiting examples of embodiments of the cavity 106, the cavity 106 may comprise a weapons bay or a landing gear bay in an aircraft. As an additional non-limiting example, the cavity 106 may represent an inlet or an outlet in a pipe.

One or more cavity walls 116-119 define the cavity 106. Additionally, there are edges 123-126 between each respective cavity wall 116-119 and the surface 113. The edge 123 is a leading edge 123 relative to the edge 126, and the edge 126 is a trailing edge 126 relative to the edge 123. In this regard, the leading edge 123 is upstream in the fluid stream 109 relative to the trailing edge 126, and the trailing edge 126 is downstream in the fluid stream 109 relative to the leading edge 123. The embodiment shown in FIGS. 1A-1B includes a base 129, but the base 129 may not be present in alternative embodiments.

When the fluid stream 109 flows across the opening of the cavity 106, a relatively high pressure level may exist at the point 133 along the cavity wall 119 near the trailing edge 126, and a relatively low pressure level may exist at the point 136 along the surface 113 near the trailing edge 126. Additionally, a relatively low pressure level may exist at the point 139 along the cavity wall 116 near the leading edge 123, and a relatively high pressure level may exist at the point 143 along the surface 113 near the leading edge 123. Furthermore, unstable sheer layers, which can be described according to the Kelvin-Helmholtz instability theorem, may exist near the surface 113. The pressure differentials at points 133, 136, 139, and 143 in conjunction with the unstable sheer layers may result in pressure oscillations. These pressure oscillations can cause damage to the body 103 and/or objects that are within or near the cavity 106.

Figure 2A:
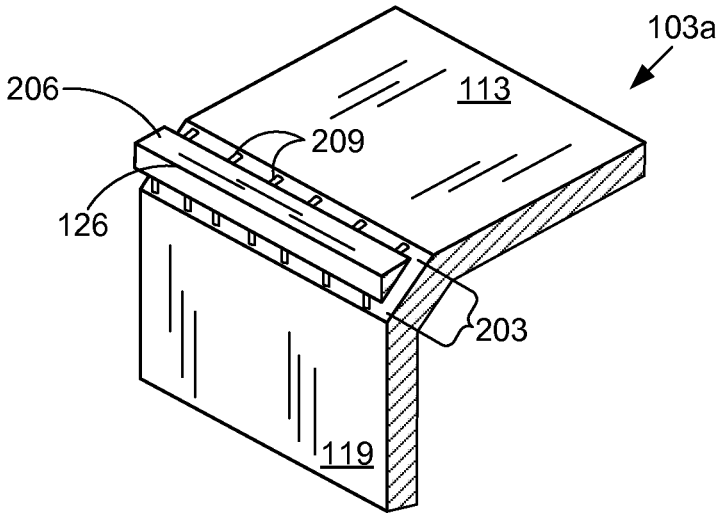
FIG. 2A is a drawing of a second example of a body with a cavity that may be exposed to a fluid stream according to various embodiments of the present disclosure.
Figure 2B:
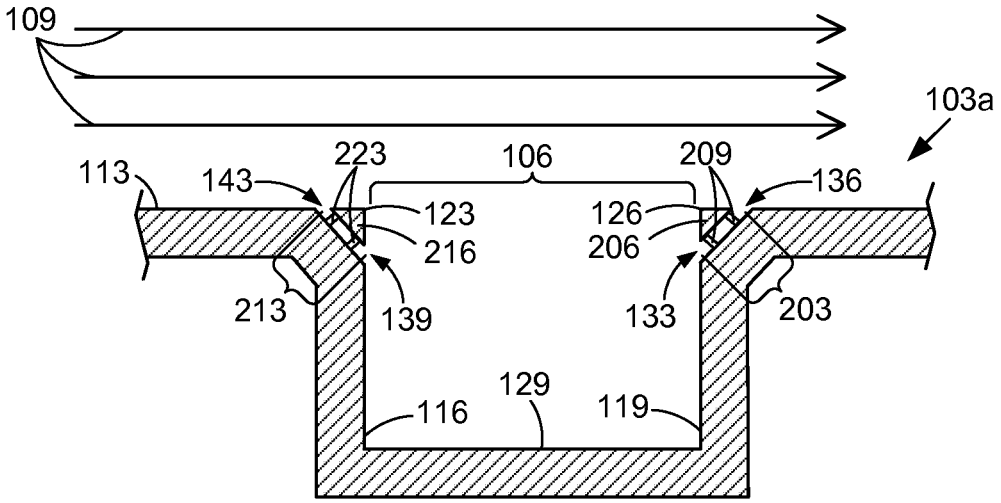
FIG. 2B is a cross-sectional view of the body of FIG. 2A with the cavity being exposed to a fluid stream according to various embodiments of the present disclosure.

With reference to FIGS. 2A-2B, shown is another example of a portion of a body 103, referred to herein as the body 103*a*, according to various embodiments of the present disclosure. In particular, FIGS. 2A-2B show cross-sections of a portion of the body 103*a*.

In the embodiment shown in FIGS. 2A-2B, a first channel 203 is formed between the cavity wall 119 and the surface 113. The first channel 203 includes one or more channel openings formed in the surface 113 and one or more channel openings formed in the cavity wall 119. As shown, some embodiments of the body 103*a* include a first edge member 206 that is separate from at least a portion of the surface 113 and at least a portion of the cavity wall 119. In particular, the first edge member 206 is separated from the remaining portions of the surface 113 and the cavity wall 119 by the first channel 203. One or more first support members 209 may provide structural support for the first edge member 206 and maintain the first edge member 206 in its position. For purposes of clarity, only a subset of the first support members 209 are labeled in FIGS. 2A-2B.

A second channel 213 is formed between the cavity wall 116 and the surface 113. The second channel 213 includes one or more channel openings formed in the surface 113 and one or more channel openings formed in the cavity wall 116. As shown, some embodiments of the body 103*a* include a second edge member 216 that is separate from at least a portion of the surface 113 and at least a portion of the cavity wall 116. In particular, the second edge member 216 is separated from the remaining portion of the surface 113 and the cavity wall 116 by the second channel 213. One or more second support members 223 may provide structural support for the second edge member 216 and maintain the second edge member 216 in position shown.

As discussed above, when the fluid stream 109 flows across the opening of the cavity 106, a relatively high pressure level may exist at the point 133 along the cavity wall 119 near the trailing edge 126, and a relatively low pressure level may exist at the point 136 along the surface 113 near the trailing edge 126. However, because the first channel 203 has one or more channel openings at the point 133 and one or more channel openings at the point 136, the first channel 203 facilitates the pressure differential across the point 133 and the point 136 being lower than would otherwise exist if the first channel 203 were not present. In this regard, the first channel 203 facilitates fluid flowing between the point 133 and the point 136 so that the pressure differential is reduced. As a result, the amplitude of the pressure oscillations that may be generated from the fluid stream 109 flowing over the cavity 106 is less than what would otherwise be generated if the first channel 203 were not present.

Additionally, as discussed above, when the fluid stream 109 flows across the opening of the cavity 106, a relatively high pressure may exist at the point 139 along the cavity wall 116 near the leading edge 123, and a relatively low pressure may exist at the point 143 along the surface 113 near the leading edge 123. However, because the second channel 213 has one or more channel openings at the point 139 and one or more channel openings at the point 143, the second channel 213 causes the pressure differential between the point 139 and the point 143 to be lower than would otherwise exist if the second channel 213 were not present.

Figure 3:
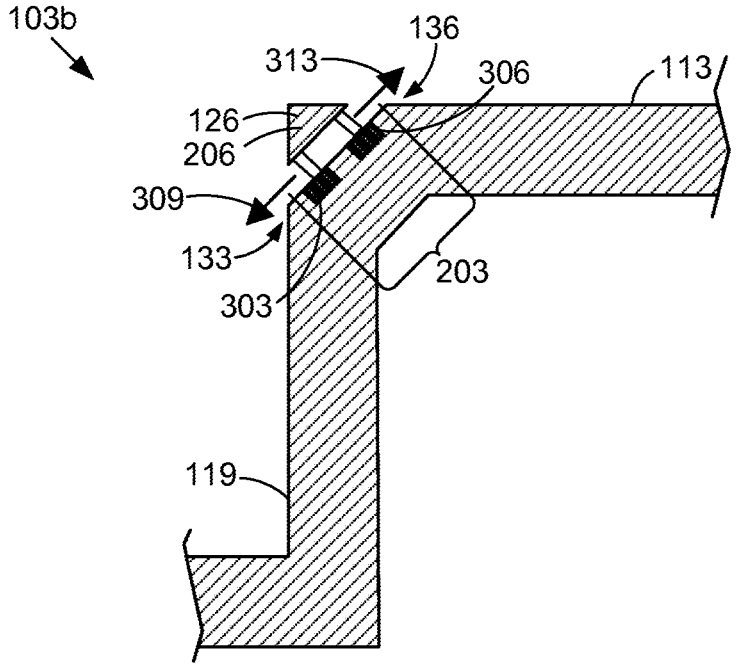
FIG. 3 is a cross-sectional view of an example of plasma actuators disposed in a channel in the body of FIG. 2A according to various embodiments of the present disclosure.

With reference to FIG. 3, shown is a portion of another example of a body 103, referred to herein as the body 103*b*, according to various embodiments of the present disclosure. In particular, FIG. 3 shows a cross-section of a portion of the body 103*b* that includes the trailing edge 126, the cavity wall 119, and the first channel 203. The second channel 213 (FIG. 2B), the leading edge 123 (FIG. 2B), and the cavity wall 116 (FIG. 2B) may include elements that are similar to the elements described with respect to FIG. 3 in various embodiments.

The body 103*b* includes one or more plasma actuators 303 and 306. Non-limiting examples of plasma actuators 303 and 306 are described in U.S. Pat. No. 8,235,072, titled "Method and Apparatus for Multibarrier Plasma High Performance Flow Control," issued on Aug. 7, 2012, U.S. Publication No. 2013/0038199, titled "System, Method, and Apparatus for Microscale Plasma Actuation," filed on Apr. 21, 2011, and WIPO Publication No. WO/2011/156408, titled "Plasma Inducted Fluid Mixing," filed on Jul. 6, 2011. Each of these documents is incorporated by reference herein in its entirety. In general, each plasma actuator 303 and 306 is configured to induce the flow of a fluid, such as air or any other type of fluid, due to the electrohydrodynamic (EHD) body force that results from the electric field lines that are generated between respective electrodes of the respective plasma actuators 303 and 306.

The plasma actuators 303 and 306 may be positioned within the first channel 203, as shown in FIG. 3. In alternative embodiments, the plasma actuators 303 and 306 may be positioned in any suitable location that is near the first channel 203. For example, the plasma actuators 303 and 306 may be mounted on the first edge member 206 within the first channel 203. As another non-limiting example, the plasma actuators 303 and 306 may be positioned on opposing sides of the first channel 203. The plasma actuators 303 and 306 are configured to generate an EHD body force that adjusts the flow of a fluid through the first channel 203. To this end, the plasma actuator 303 may be configured to generate an EHD body force in the direction indicated by the arrow 309, and the plasma actuator 306 may be configured to generate an EHD body force in the direction indicated by the arrow 313. In some embodiments, the plasma actuator 303 may be configured to generate an EHD body force in the direction indicated by the arrow 313, and/or the plasma actuator 306 may be configured to generate an EHD body force in the direction indicated by the arrow 309.

In some embodiments, the respective plasma actuators 303 and 306 may be dynamically activated in response to the pressure differential that exists across the first channel 203. To this end, one or more sensors (not shown), such as pressure sensors and/or any other suitable type of sensor, may be located near the openings of the first channel 203. The sensors in conjunction with any suitable hardware, software, or combination thereof are used to measure the pressure differential across the first channel 203 and to activate the respective plasma actuators 303 and 306 responsive to the measured pressure differential. For example, if sensors indicate that the pressure level at the point 136 near the surface 113 is greater than the pressure level at the point 133 near the cavity wall 119, the plasma actuator 303 is activated to generate an EHD body force in the direction indicated by the arrow 309. The EHD body force may facilitate fluidic flow in the direction indicated by the arrow 309. As a result, the pressure differential across the first channel 203 may be reduced. Similarly, if sensors indicate that the pressure level at the point 136 near the surface 113 is lower than the pressure level at the point 133 near the cavity wall 119, the plasma actuator 306 may be activated to generate an EHD body force in the direction indicated by the arrow 313. The EHD body force may facilitate fluidic flow in the direction indicated by the arrow 313. As a result, the pressure differential across the first channel 203 may be reduced. Thus, the one or more plasma actuators 303 and 306 may be used to actively attenuate the amplitude of the pressure oscillations that may be generated by the fluid stream 109 (FIG. 2B) flowing across the cavity 106 (FIG. 2B).

With reference to FIGS. 4-8, shown are examples of a portion of a body 103, referred to herein as the bodies 103*c*-103*g*, according to various embodiments of the present disclosure. In particular, FIGS. 4-8 show cross-sections of portions of the bodies 103*c*-103*g* having various types of first channels 203 and first edge members 206. It is understood that the second channel 213 (FIG. 2B) and the second edge member 216 (FIG. 2B) may include elements that are similar to the elements discussed in FIGS. 4-8. It is also understood that the embodiments shown in FIGS. 4-8 may or may not include one or more plasma actuators 303 and 306 (FIG. 3).

Figure 4:
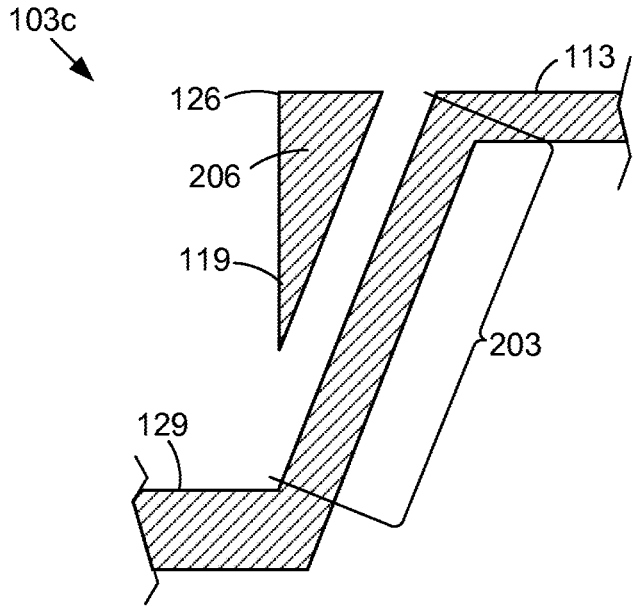
FIGS. 4-7 are cross-sectional views of examples of types of channels that may be formed in the body of FIG. 2A according to various embodiments of the present disclosure.
Figure 5:
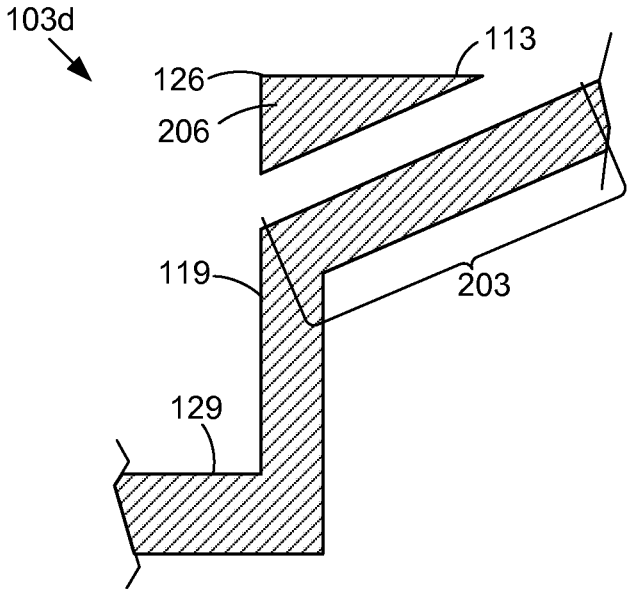

FIG. 4 shows that one or more openings for the first channel 203 may be formed in the cavity wall 119 and located relatively close to the base 129 and relatively far from the surface 113, as compared to the embodiment shown in FIGS. 2A-2B. FIG. 5 shows that one or more openings for the first channel 203 may be formed in surface 113 and located relatively far from the cavity wall 119, as compared to the embodiment shown in FIGS. 2A-2B.

Figure 6:
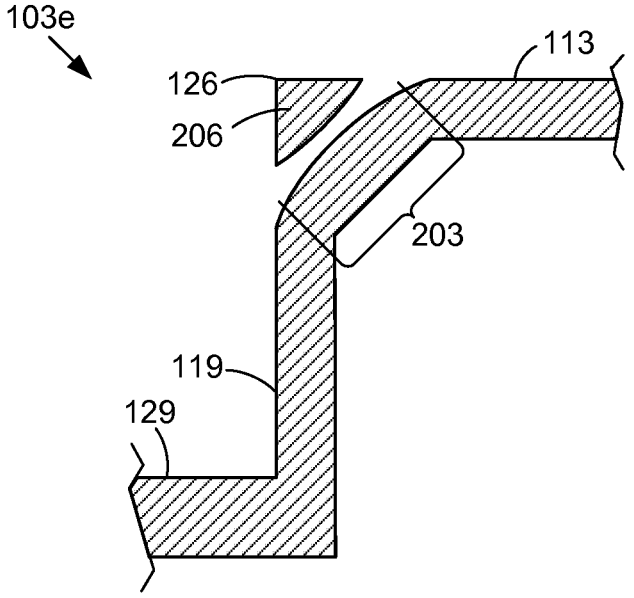
Figure 7:
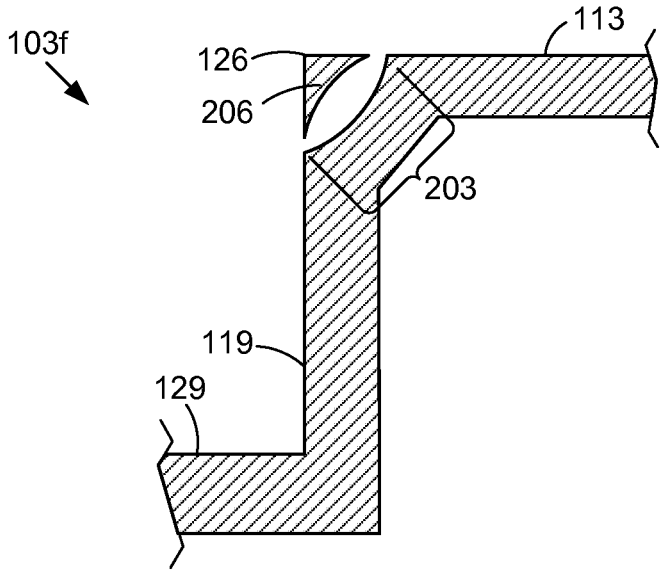
Figure 8:
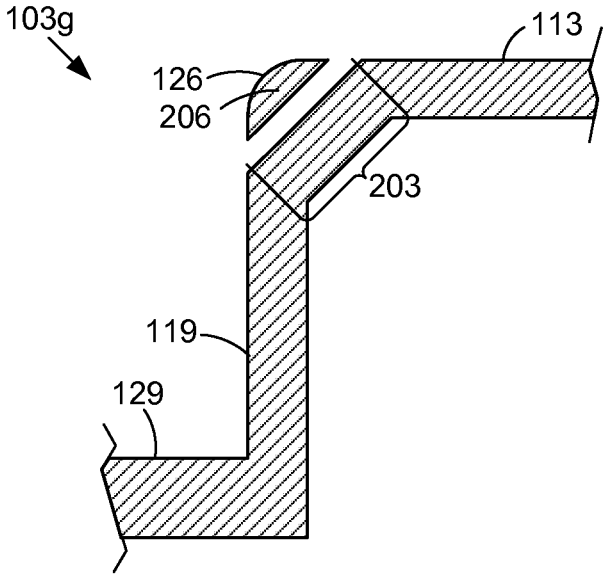
FIG. 8 is a drawing of an example of the body of FIG. 2A with an edge piece according to various embodiments of the present disclosure.

The first channel 203 may take the form of various types of shapes. For example, as shown in FIG. 6, the first channel 203 may form a throat that narrows in width as the distance from the cavity wall 119 and/or the surface 113 is increased. As another example, the first channel 203 shown in FIG. 7 widens as the distance from the cavity wall 119 and/or the surface 113 is increased. As shown in FIG. 8, the edge 123 may have a curved surface in some embodiments.

Figure 9:
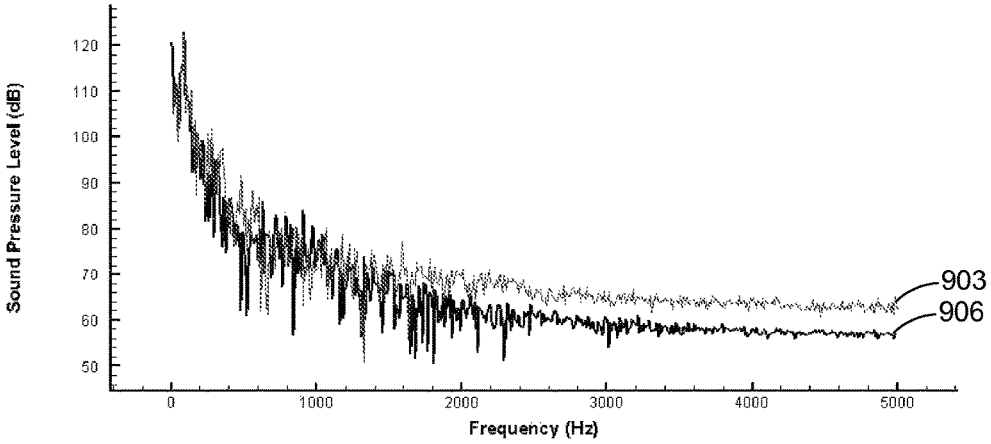
FIGS. 9-11 are drawings depicting results of simulations of the bodies of FIGS. 1A-1B and 2A-2B being exposed to fluid streams according to various embodiments of the present disclosure.
Figure 10:
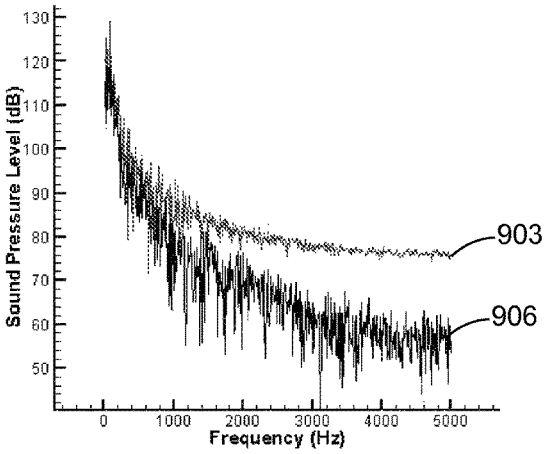
Figure 11:
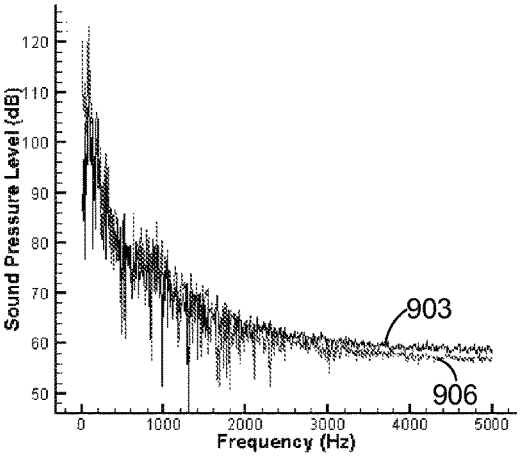

With reference to FIGS. 9-11, shown are drawings depicting the results of simulations of the body 103 (FIGS. 1A-1B) and the body 103*a* (FIGS. 2A-2B) being exposed to fluid streams 109. In particular, the line 903 represents the simulated results for the body 103, which does not have the first channel 203, and the line 906 represents the simulated results for the body 103*a*, which has the first channel 203. More specifically, FIG. 9 shows the resulting sound pressure levels near the base 129 (FIGS. 1B and 2B), FIG. 10 shows the resulting sound pressure levels near the trailing edge 126 (FIGS. 1B and 2B), and FIG. 11 shows the resulting sound pressure levels near the leading edge 123 (FIGS. 1B and 2B). As shown, embodiments that include the first channel 203 and/or the second channel 213 may result in sound pressure levels that are lower than the sound pressure levels that would otherwise exist if the first channel 203 and/or the second channel 213 were not present.

Figure 12:
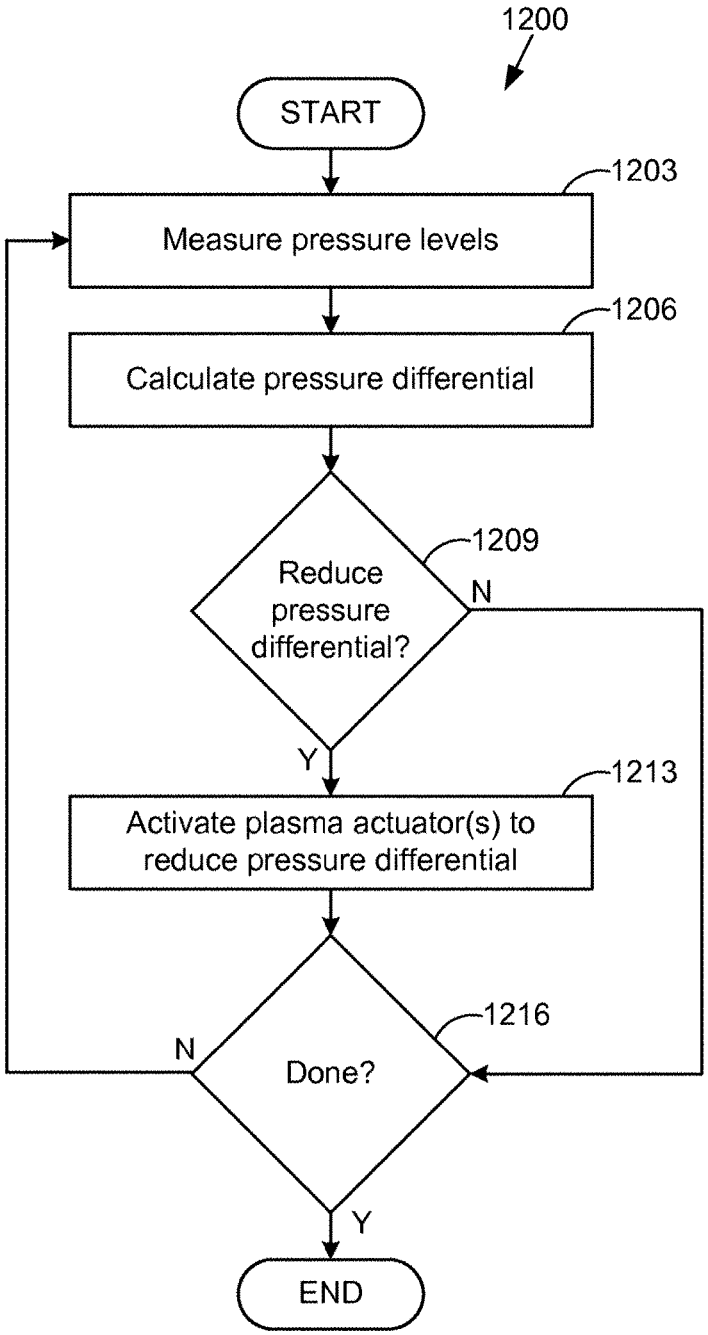
FIG. 12 is a flowchart illustrating an example of functionality implemented by a controller for the plasma actuators of FIG. 3 according to various embodiments of the present disclosure.

With reference to FIG. 12, shown is a flowchart that provides an example of the operation of a controller 1200 for the plasma actuators 303 and 306 according to various embodiments. It is understood that the flowchart of FIG. 12 provides merely an example of the many types of functional arrangements that may be employed to implement the function of the controller 1200 as described herein. The flowchart of FIG. 12 may be viewed as depicting an example of elements of a method implemented by the controller 1200.

The controller 1200 in various embodiments may comprise one or more computing devices, such as a microcontroller, a programmable logic device (e.g., a field-programmable gate array (FPGA) or a complex programmable logic device (CPLD)), an application specific integrated circuit (ASIC), a circuit comprising discrete logic elements, or any other suitable device, coupled to the plasma actuators 303 and 306. In some embodiments, the controller 1200 includes at least one processor circuit, having a processor and memory coupled to a bus structure, such as an address/control bus. In addition, the memory may store computing instructions that, when executed by the processor circuit, causes the processor circuit to perform the functionality described herein. Accordingly, the controller 1200 in various embodiments may be embodied in the form of hardware, software, or a combination of hardware and software.

Beginning at element 1203, the controller 1200 measures the pressure levels at points near the openings of the first channel 203. To this end, one or more pressure sensors may be located near the openings of the first channel 203, and the controller 1200 may read values that correspond to the pressure levels. At element 1206, the controller 1200 calculates the pressure differential across the first channel 203.

The controller 1200 then moves to element 1209 and determines whether the pressure differential across the first channel 203 is to be reduced. In one embodiment, the controller 1200 determines to reduce the pressure differential if the pressure differential is greater than a particular value. In another embodiment, the controller 1200 determines to reduce the pressure differential if the pressure differential is increasing from a previously measured pressure differential. If the controller 1200 determines to not reduce the pressure differential, the controller 1200 moves to element 1216.

Otherwise, if the controller 1200 determines to reduce the pressure differential, the controller 1200 moves to element 1213 and activates one or more of the plasma actuators 303 and 306 in order to reduce the pressure differential. For example, if sensors indicate that the pressure level at the point 136 near the surface 113 is greater than the pressure level at the point 133 near the cavity wall 119, the plasma actuator 303 is activated to generate an EHD body force in the direction indicated by the arrow 309. Similarly, if sensors indicate that the pressure level at the point 136 near the surface 113 is lower than the pressure level at the point 133 near the cavity wall 119, the plasma actuator 306 may be activated to generate an EHD body force in the direction indicated by the arrow 313.

As shown at element 1216, the controller 1200 then determines whether the process is complete. If the process is not complete, the controller 1200 returns to element 1203, and the process repeats as shown. Otherwise, the process ends.

Although the flowchart of FIG. 12 shows a specific order of execution, the order of execution may differ from that which is depicted. For example, the order of execution of two or more elements in FIG. 12 may be switched relative to the order shown. Also, two or more elements shown in succession in FIG. 12 may be executed concurrently or with partial concurrence. Further, in some embodiments, one or more of the elements shown in FIG. 12 may be skipped or omitted.

Disjunctive language used herein, such as the phrase "at least one of X, Y, or Z," unless indicated otherwise, is used in general to present that an item, term, etc., may be either X, Y, or Z, or any combination thereof (e.g., X, Y, and/or Z). Thus, such disjunctive language does not imply that certain embodiments require at least one of X, at least one of Y, or at least one of Z to each be present.

The above-described embodiments of the present disclosure are merely possible examples of implementations set forth for a clear understanding of the principles of the disclosure. Many variations and modifications may be made to the above-described embodiments without departing substantially from the spirit and principles of the disclosure. All such modifications and variations are intended to be included herein within the scope of this disclosure.

The invention claimed is:

1. A system, comprising:

a surface configured to be exposed to a fluid stream, wherein a first channel opening is formed in the surface;

a cavity wall that forms at least a portion of a cavity, wherein a second channel opening is formed in the cavity wall, wherein a channel extends from the second channel opening in the cavity wall to the first channel opening in the surface; and a plasma actuator disposed in the channel.

2. The system of claim 1, wherein the plasma actuator is among a plurality of plasma actuators disposed in the channel.

3. The system of claim 2, wherein at least one of the plurality of plasma actuators is configured to produce a first electrohydrodynamic (EHD) body force in a direction that is different from a second EHD body force that is produced by at least one other one of the plurality of plasma actuators.

4. The system of claim 1, wherein the plasma actuator is configured to be dynamically activated in response to a pressure differential between a first location proximate to the first channel opening and a second location proximate to the second channel opening.

5. The system of claim 1, wherein the plasma actuator is configured to be dynamically activated in response to a pressure level.

6. A method, comprising:

exposing a surface to a fluid stream, wherein an opening of a cavity is formed in the surface, wherein a channel extends from a first channel opening formed in the surface to a second channel opening formed in a cavity wall that forms at least a portion of the cavity; and activating a plasma actuator disposed in the channel to adjust a pressure differential associated with the channel.

7. The method of claim 6, wherein the plasma actuator is activated dynamically in response to the pressure differential.

8. The method of claim 6, wherein the plasma actuator is among a plurality of plasma actuators disposed in the channel.

9. The method of claim 8, further comprising:

activating at least one of the plurality of plasma actuators to generate a first electrohydrodynamic (EHD) body force in a first direction; and activating at least one of the plurality of plasma actuators to generate a second EHD body force in a second direction, wherein the second EHD body force is generated subsequent to the first EHD body force being generated.

10. The method of claim 6, further comprising measuring a plurality of pressure levels.

11. The method of claim 10, further comprising calculating the pressure differential using the plurality of pressure levels.

12. The method of claim 6, wherein exposing the surface to the fluid stream comprises flying an aircraft through air.

13. The method of claim 6, wherein exposing the surface to the fluid stream comprises causing a fluid to flow through a pipe.

14. An apparatus, comprising:

a surface configured to be exposed to a fluid stream, wherein a first channel opening is formed in the surface;

a cavity wall that forms at least a portion of a cavity, wherein a second channel opening is formed in the cavity wall;

wherein a channel extends from the second channel opening in the cavity wall to the first channel opening in the surface; and a plasma actuator disposed in the channel.

15. The apparatus of claim 14, further comprising an additional plasma actuator disposed in the channel, wherein the plasma actuator is configured to produce a first electrohydrodynamic (EHD) body force in a first direction, and wherein the additional plasma actuator is configured to produce a second EHD body force in a second direction that is opposite of the first EHD body force.

16. The apparatus of claim 14, further comprising an edge member that is separate from at least a portion of the surface and at least a portion of the cavity wall.

17. The apparatus of claim 16, wherein the edge member comprises a triangular cross section.

18. The apparatus of claim 16, wherein the edge member comprises a curved exterior edge.

19. The apparatus of claim 14, wherein the surface comprises an aircraft skin.

* * * * *